US010309148B2

(12) United States Patent
Glover

(10) Patent No.: US 10,309,148 B2
(45) Date of Patent: Jun. 4, 2019

(54) POLYCARBONATE HONEYCOMB CORE DOOR AND METHOD OF MAKING SAME

(71) Applicant: AADG, Inc., Milan, TN (US)

(72) Inventor: Daniel Brian Glover, Franklin, TN (US)

(73) Assignee: AADG, Inc., Milan, TN (US)

( * ) Notice: Subject to any disclaimer, the term of this patent is extended or adjusted under 35 U.S.C. 154(b) by 0 days.

(21) Appl. No.: 15/709,553

(22) Filed: Sep. 20, 2017

(65) Prior Publication Data

US 2018/0087315 A1 Mar. 29, 2018

Related U.S. Application Data

(60) Provisional application No. 62/401,318, filed on Sep. 29, 2016, provisional application No. 62/400,157, filed on Sep. 27, 2016.

(51) Int. Cl.

| | |
|---|---|
| ***E06B 3/70*** | (2006.01) |
| ***E06B 3/22*** | (2006.01) |
| ***E06B 3/26*** | (2006.01) |
| ***E06B 5/12*** | (2006.01) |
| ***E06B 3/267*** | (2006.01) |
| ***E06B 3/82*** | (2006.01) |

(52) U.S. Cl.

CPC ..... *E06B 3/7015* (2013.01); *E06B 3/221* (2013.01); *E06B 3/2675* (2013.01); *E06B 3/7017* (2013.01); *E06B 3/822* (2013.01); *E06B 5/12* (2013.01); *E06B 2003/7023* (2013.01); *E06B 2003/7051* (2013.01); *E06B 2003/7082* (2013.01)

(58) Field of Classification Search

CPC ..... E06B 3/7015; E06B 5/12; E06B 3/2675; E06B 3/221; E06B 2003/7051; E06B 2003/7023; E06B 2003/7082

See application file for complete search history.

(56) References Cited

U.S. PATENT DOCUMENTS 3,177,533 A 4/1965 Davis
3,564,770 A * 2/1971 Korbelic ..... E06B 7/02 160/222

(Continued)

FOREIGN PATENT DOCUMENTS

JP 2003146252 A 5/2003

*Primary Examiner* — Jeanette E Chapman
(74) *Attorney, Agent, or Firm* — DeLio, Peterson & Curcio, LLC; Peter W. Peterson

(57) ABSTRACT

A structural panel includes a shell having spaced first and second exterior panels and frame members adjacent edges of the panels, and at least one polymeric sheet disposed between the exterior panels and bonded to an adjacent exterior panel. The polymeric sheet is made of a thermoplastic material and has a plurality of openings through its thickness spaced apart by flat wall portions of the polymeric sheet. Stiffeners are disposed between the polymeric sheets and are secured by polymeric end caps. The end caps are made of a thermoplastic material and have a plurality of openings through their thickness for receiving the stiffeners. A foam insulation material fills substantially all the space between the polymeric sheets, stiffeners, and frame members in the shell interior. At least one blast- or ballistic-resistant core layer may be disposed adjacent the at least one polymeric sheet.

13 Claims, 4 Drawing Sheets

(56) References Cited

U.S. PATENT DOCUMENTS

| | | | | |
|---|---|---|---|---|
| 3,812,972 | A * | 5/1974 | Rosenblum | B01D 25/001 210/489 |
| 3,950,894 | A | 4/1976 | DiMaio | |
| 4,091,142 | A | 5/1978 | Elmore | |
| 4,294,055 | A | 10/1981 | Andresen | |
| 4,686,806 | A | 8/1987 | Bennett | |
| 4,743,485 | A | 5/1988 | Ting | |
| 5,221,807 | A * | 6/1993 | Vives | F41H 5/023 109/82 |
| 5,566,611 | A * | 10/1996 | Scheucher | B30B 9/121 100/117 |
| 6,568,310 | B2 | 5/2003 | Morgan | |
| 6,635,820 | B1 * | 10/2003 | Mair | H05K 9/0041 174/377 |
| 7,001,656 | B2 | 2/2006 | Maignan | |
| 7,252,764 | B2 * | 8/2007 | Scherer | B01D 61/18 156/77 |
| 8,128,327 | B2 * | 3/2012 | Jevaney | B61D 45/006 410/118 |
| 8,418,427 | B2 | 4/2013 | Strickland | |
| 9,493,944 | B1 * | 11/2016 | Wesseler | E04B 1/80 |
| 10,022,935 | B2 * | 7/2018 | Hermann | B32B 3/266 |
| 2004/0003559 | A1 | 1/2004 | Minke | |
| 2004/0128947 | A1 | 7/2004 | Ito et al. | |
| 2006/0206977 | A1 | 9/2006 | Hammons | |
| 2008/0115432 | A1 | 5/2008 | Groppe | |
| 2010/0101182 | A1 | 4/2010 | Murchie | |
| 2010/0257802 | A1 | 10/2010 | Strickland et al. | |
| 2011/0186765 | A1 * | 8/2011 | Jaeb | F04B 43/046 251/331 |
| 2012/0048487 | A1 | 3/2012 | Brewster | |
| 2012/0180633 | A1 | 7/2012 | Dagher | |
| 2015/0217535 | A1 | 8/2015 | Bidgoli | |
| 2015/0266260 | A1 | 9/2015 | Fujioka | |
| 2016/0380345 | A1 | 12/2016 | Kolak | |
| 2017/0022751 | A1 | 1/2017 | Wang | |
| 2017/0022752 | A1 | 1/2017 | Wang | |

* cited by examiner

POLYCARBONATE HONEYCOMB CORE DOOR AND METHOD OF MAKING SAME

RELATED APPLICATIONS

This application is related to U.S. patent application Ser. No. 15/662,936 filed on Jul. 28, 2017 entitled "Insulated Reinforced Door Panel and Door Frame with Thermal Break;" U.S. patent application Ser. No. 15/679,273, filed on Aug. 17, 2017, entitled "Insulated Fiber Reinforced Door Panel and Method of Making Same" and U.S. patent application Ser. No. 15/710,909 filed on even date herewith entitled "Fiber Reinforced Plastic Door with Polycarbonate Ballistic Core and Method of Making Same."

BACKGROUND OF THE INVENTION

1. Field of the Invention

The present invention relates to insulated structural panels that may be used as doors, and in particular, door panels having improved rigidity, blast and ballistic resistance, thermal efficiency, aesthetics and manufacturability.

2. Description of Related Art

Commercial hollow metal and wood door cores typically consist of Polystyrenes, Polyurethanes, Polyisocyanurate, Honeycomb (Kraft paper), Stave Lumber, Particleboard, Agra-Fiber, Mineral Core, Rock Wool, Fiberglass, Blast-Resistant, and Bullet-Resistant materials. Each core type has a different performance function and price point. Maintaining all of these core types adds complexity, inventory, and costs that could be reduced. Steel reinforcements and steel end caps may also be employed, yet they are conductive for thermal and electrical energy. These steel reinforcements may not be dimensionally stable under thermal loading, negatively impacting the energy efficiency of the door opening thermal performance for preventing thermal transfer. The steel is also vulnerable to corrosion and rusting, and greatly increases the total weight of the door. This added weight impacts hardware wear and tear, product lifestyle, and cost of ownership. The weight of components and finished door total weight also impacts freight and shipment costs of raw components, and finished goods shipment cost.

SUMMARY

Bearing in mind the problems and deficiencies of the prior art, it is therefore an object of the present invention to provide a structural panel that may be used as a door with improved structural integrity, blast- and ballistic-resistance, and/or thermal efficiency.

It is another object of the present invention to provide a structural panel which provides a reduction in weight without sacrificing structural strength and blast- and ballistic-resistance (if employed).

It is yet another object of the present invention to provide a structural panel which is dimensionally stable to reduce thermal bow effect.

Still another object of the present invention is to provide a structural panel which provides sound transmission class (STC) improvement.

A further object of the present invention is to provide a structural panel which provides improvement in thermal insulation and air infiltration.

The above and other objects, which will be apparent to those skilled in the art, are achieved in the present invention which is directed to a panel which may be used as a door. The panel comprises a shell having spaced first and second exterior panels and frame members adjacent edges of the panels. At least one polymeric sheet is between the first and second exterior panels, the at least one polymeric sheet being made of a thermoplastic material, and has a plurality of openings through a thickness thereof. The openings are spaced apart by flat wall portions of the polymeric sheet.

The panel may include a plurality of polymeric sheets. In an embodiment, the sheets are stacked with the openings of one sheet offset from the openings of an adjacent sheet, and the openings of one sheet are adjacent flat wall portions of the adjacent sheet. The polymeric sheet may be bonded to an adjacent exterior panel. The at least one polymeric sheet may be spaced from an adjacent exterior panel, and a foam insulation material may substantially fill all of the space therebetween. A plurality of polymeric sheets and a plurality of stiffeners may be disposed between the polymeric sheets.

An embodiment of the panel may further include securing stiffeners by a polymeric end cap made of a thermoplastic material, the end cap which has a plurality of openings through a thickness thereof. The ends of the stiffeners are received within the openings of the polymeric end cap, and the openings of the polymeric end cap are oriented 90° to the openings of the polymeric sheets. A foam insulation material may fill substantially all of the space between the polymeric sheets, stiffeners, and frame members in the shell interior portion.

The present invention also provides a method of making a panel which may be used as a door. First and second exterior panels and frame members are provided for a door shell. At least one polymeric sheet being made of a thermoplastic material is also provided. The polymeric sheet has a plurality of openings through a thickness thereof, the openings being spaced apart by flat wall portions of the polymeric sheet. The first and second exterior panels, frame members, and the at least one polymeric sheet are assembled to make a shell having spaced first and second exterior panels and frame members adjacent edges of the panels. The at least one polymeric sheet is between adjacent exterior panels and bonded to them.

The method may further include the at least one polymeric sheet being spaced apart from adjacent exterior panels, with a curable and hardenable foam insulation material injected therebetween. The insulation provides both thermal insulation and a chemical bond with the polymeric sheet and exterior panels when cured. The method may also include a plurality of polymeric sheets and a plurality of stiffeners comprising a thermally non-conductive fiber reinforced polymer. The plurality of stiffeners are assembled between the polymeric sheets.

The present invention also provides a structural panel which may be used as a door. A shell has spaced first and second exterior panels and frame members adjacent edges of the panels. At least one polymeric sheet is between the first and second exterior panels. The at least one polymeric sheet is made of a thermoplastic material and has a plurality of openings through a thickness thereof. The openings are spaced apart by flat wall portions of the polymeric sheet. At least one blast- or ballistic-resistant core layer is adjacent the at least one polymeric sheet.

An embodiment of the panel includes a plurality of polymeric sheets wherein the at least one blast- or ballistic-resistant core layer is between a pair of the polymeric sheets. The panel may further include a plurality of polymeric sheets wherein the sheets are stacked with the openings of one sheet being offset from the openings of an adjacent sheet. The openings of one sheet are adjacent flat wall portions of the adjacent sheet. The at least one polymeric sheet may further be bonded to an adjacent exterior panel. The at least one polymeric sheet may also be spaced from an adjacent exterior panel, with a foam insulation material filling substantially all of the space therebetween.

The present invention additionally provides a method of making a panel which may be used as a door. First and second exterior panels and frame members for a door shell are provided. The method also provides at least one polymeric sheet being made of a thermoplastic material and having a plurality of openings through a thickness thereof. The openings are spaced apart by flat wall portions of the polymeric sheet. At least one blast- or ballistic-resistant core layer is also provided. The first and second exterior panels, frame members, at least one polymeric sheet, and at least one blast- or ballistic-resistant core layer are assembled to make a shell having spaced first and second exterior panels and frame members adjacent edges of the panels. The at least one polymeric sheet is between adjacent exterior panels, and the at least one blast- or ballistic-resistant core layer is adjacent the at least one polymeric sheet. The at least one polymeric sheet is bonded to adjacent exterior panels.

The method may further provide a plurality of polymeric sheets, and assembling the at least one blast- or ballistic-resistant core layer between the polymeric sheets. The at least one polymeric sheet may be spaced from an adjacent exterior panel, and the method may further include injecting a curable and hardenable foam insulation material therebetween. When cured, the insulation provides both thermal insulation and a chemical bond with the polymeric sheet and exterior panels.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF EMBODIMENT(S)

Figure 3:
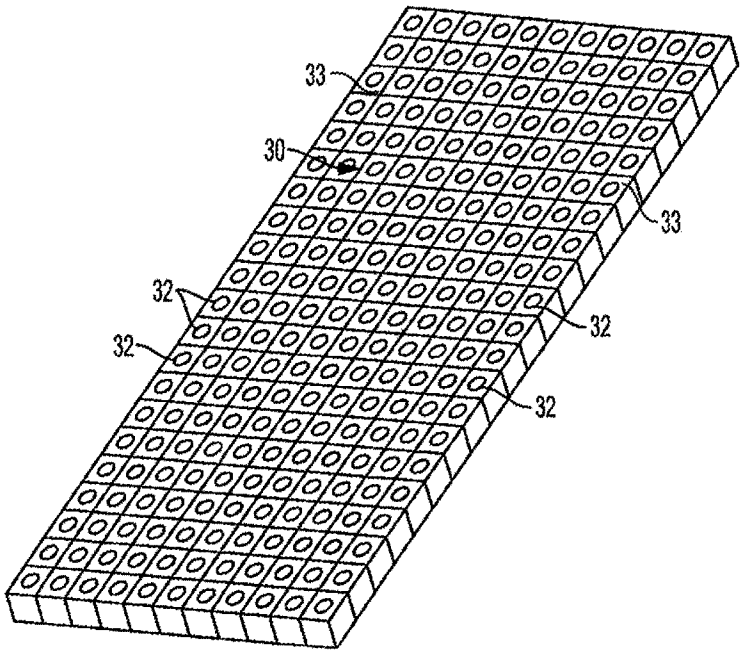
FIG. 3 is a perspective view of an embodiment of the honeycomb polycarbonate sheet used in the internal structure of the door panel of FIG. 1.
Figure 1:
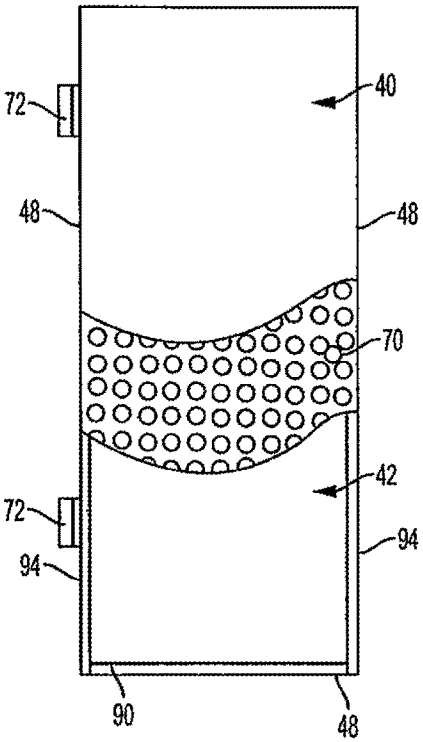
FIG. 1 is a front elevational view with partial cutaway of an embodiment of the door panel according to the present invention.
Figure 2:
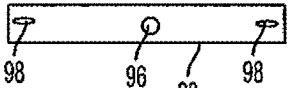
FIG. 2 is an end view of the lower frame member of the door panel of FIG. 1.

In describing the preferred embodiment of the present invention, reference will be made herein to FIGS. 1-11 of the drawings in which like numerals refer to like features of the invention. Reference will also be made to the general direction of orientation of the door panel 20 of the invention.

The drawings show alternate embodiments of the structural panel 20 of the present invention, which is in the embodiment shown a door panel. The door shell includes an inner panel 40 and a spaced outer panel 42 opposite the inner panel. The inner panel 40 and outer panel 42 form the exterior panels of the door, and may also be referred to as the door skin. The exterior panels may be made of any suitable sheet material, for example a metal or alloy such as about 14, 16, 18 or 20 gauge steel, a fiber reinforced plastic (FRP), wood or composite. The exterior panels may be flat or embossed. The door 20 includes door edges 48 extending between the periphery of the inner and outer panels. Upper and lower door edges 48 are formed by elongated upper and lower frame members 90, which may have a "U" or "C" channel cross-section, to which the inner and outer panels 40, 42 are welded or otherwise adhered. Side door edges 48 also have a "U" or "C" cross-section 94, which may be formed by folding the side edges of outer panel 42. There may be provided in the frame members one or more slots or openings 98 for hanging panel 20 during the manufacturing process, such as when painting, and one or more slots or openings 96 for injecting foam insulation (FIGS. 2, 7 and 9) (discussed further below). A preparation opening 70 for a lock and/or door handle may be provided, along with hinges 72 (FIGS. 1 and 8) to secure the door to a door opening (not shown). Although the panel 20 is shown in use as a door, alternatively, the present invention may be used as a wall or other structural panel, without the door hardware.

In the interior portion of the shell between the inner and outer exterior panels there is disposed one or more planar polymeric sheet(s) 30, 30*a*, 30*b* made of a thermoplastic material, such as a polycarbonate, with opposite sides or walls. The polymeric sheet 30, 30*a*, 30*b* is formed with a honeycomb pattern having a plurality of regularly spaced, patterned openings or holes 32 between flat wall portions 33, which openings may be molded in during forming of the thermoplastic, or otherwise formed through the thickness of the polymeric sheet. The openings 32 may have any desired cross-section, such as circular, square, rectangular or polygonal. The polymeric sheet 30, 30*a*, 30*b* is both thermally and electrically non-conductive. The sheet dimensions may be sized to fill substantially the entire interior of the panel volume, or may be of lesser width, height or thickness than the interior space formed by the panel skins and edges. The thermoplastic material and dead air space formed by the openings 32 provides thermal insulation through the panel thickness. If a plurality of stacked polymeric sheets of lesser thickness are used, to provide additional thermal insulation each sheet may be staggered or offset from the adjacent panel so that the holes or openings of one sheet are offset from those of the adjacent sheet, and are instead aligned with the polymeric wall between openings of an adjacent sheet.

Figure 4:
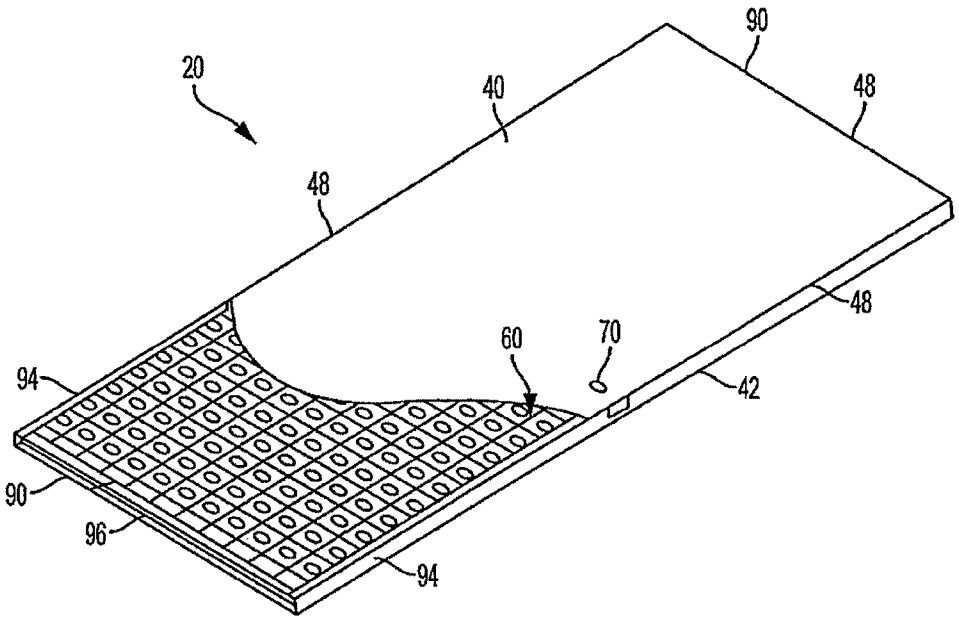
FIG. 4 is a perspective view with partial cutaway of the door panel of FIG. 1.

In one embodiment (FIGS. 1-4) no additional reinforcing is placed inside the panel, and the polymeric sheet may be adhered or bonded to the inside faces of the exterior panels or skins by a structural adhesive, applied either in a plurality of beads or sprayed on substantially the entire surface. If a plurality of stacked thinner polymeric sheets are employed, adhesive may be applied between each sheet. Optionally, a single polymeric sheet 30 may have a thinner dimension, for example 0.5 in. less than the interior dimension, and may be foamed in place. Spacers may be placed between the door panels or skins and the polymeric sheet 30 to form, for example, a 0.25 in. gap on each side, and a foam material may be pumped in on each side of the sheet 30 via openings 96. This may be a curable and hardenable insulation material 60 which fills the interior cavities between polymeric sheet 30 and the inner and outer panels 40, 42 (FIG. 4). The insulation material may be expanded foam such as polyurethane expanding foam available from BASF. The foam when cured acts to provide additional thermal insulation through the thickness of the panel. Additionally, the cured foam adheres to and acts to lock the polymeric sheet 30 in place to prevent movement thereof. The foam material may also be applied between adjacent sheets 30*a, b* if a plurality of thinner, stacked polymeric sheets are employed, and may encapsulate the polymeric sheet(s).

In another embodiment (FIGS. 8-11) a pair of polymeric sheets are employed, and each polymeric sheet may be adhered or bonded to the inside faces of the exterior panels or skins by a structural adhesive, applied either in a plurality of beads or sprayed on substantially the entire surface. Optionally, spacers may be placed between the door panels or skins and each polymeric sheet 30*a, b* to form, for example, a 0.25 in. gap on each side, and a foam material may be pumped in on each side of the polymeric sheets 30*a*, 30*b* via openings 96. This may be a curable and hardenable insulation material 60 which fills the interior cavities between polymeric sheet 30*a, b* and the inner and outer panels 40, 42 (FIG. 4). The insulation material may be expanded foam such as polyurethane expanding foam available from BASF. The foam when cured acts to provide additional thermal insulation through the thickness of the panel. Additionally, the cured foam adheres to and acts to lock the polymeric sheet 30*a, b* in place to prevent movement thereof. The foam material may also be applied between adjacent sheets 30*a, b* if a plurality of thinner, stacked polymeric sheets are employed, and may encapsulate the polymeric sheet(s).

Figure 10:
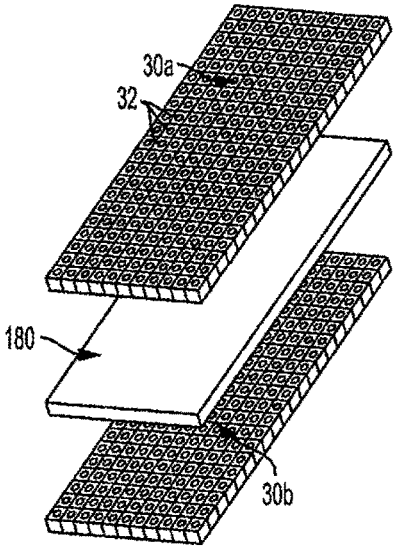
FIG. 10 is an exploded perspective view of embodiments of the polymeric sheets and blast- and/or ballistic-resistant core for the door panel embodiment of FIG. 8.
Figure 9:
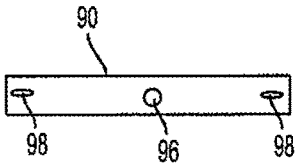
FIG. 9 is a cross section of the lower frame member of the insulated reinforced door panel embodiment of FIG. 8.
Figure 11:
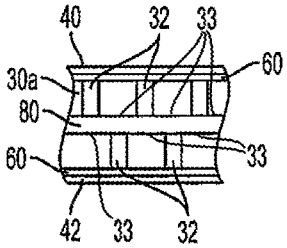
FIG. 11 is a cutaway cross sectional view along line 11-11 of the optional layers of the door panel embodiment of FIG. 8.

In the interior portion, between the polymeric sheets, one or more core layers of a blast-resistant or ballistic-resistant material 180 extend substantially between the door edges (FIG. 10). The blast-resistant or anti-ballistic material 180 may be made of any suitable rigid or flexible sheet material, for example polymeric materials such as Kevlar or other aramids, Lexan, carbon-fiber composites, or traditional metal armor. The former materials add less mass to the door panel. The core layers may be provided to any desired blast- or ballistic-resistant standards, such as UL 762 ballistic standard, levels 1 through 8 or shotgun, ASTM F1642, ASTM F2927, UFC 4-010-01 9, GSA TS-01 Level C and D blast standard. The core layers may be made to conform to other standards for other properties, such as sound transmission class (STC), radio frequency (RF) shielding, or fire rating. For a typical 1¾ in. or 2 in. door, the thicknesses of the core layer(s) in combination with the polymeric sheet(s) may be selected to provide the most desirable properties to the desired sandwiched or hybrid specialty core.

Figure 5:
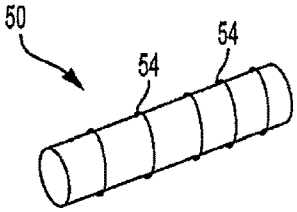
FIG. 5 is a perspective view of a FRP stiffener used in another embodiment of the door panel according to the present invention.
Figure 6:
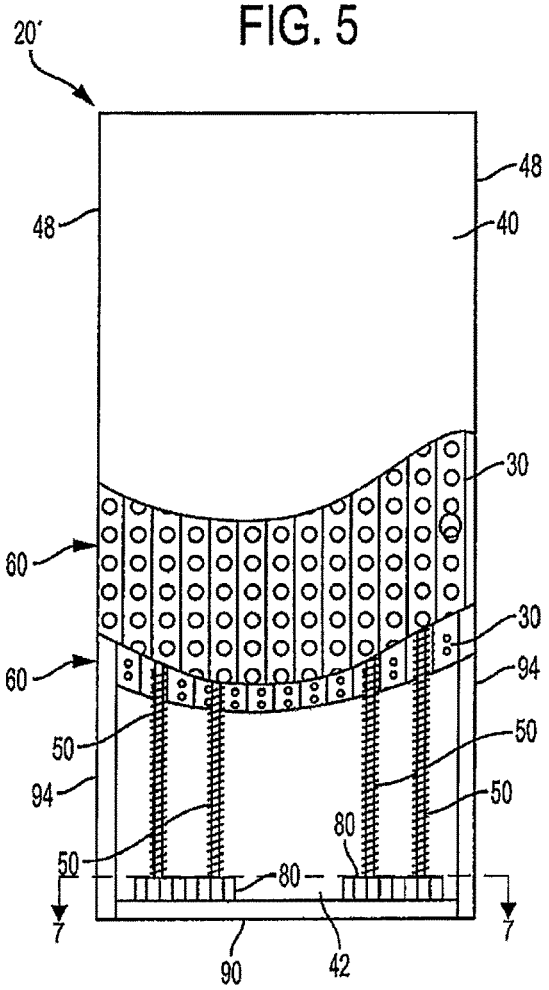
FIG. 6 is a front elevational view with partial cutaway of the other embodiment of the door panel employing the FRP stiffener of FIG. 5.
Figure 7:
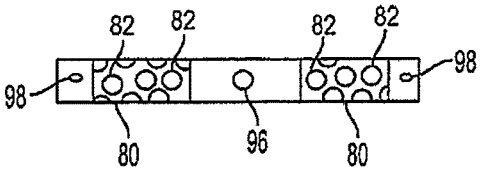
FIG. 7 is a cutaway end view along line 7-7 of the lower frame members of the door panel of FIG. 6.
Figure 8:
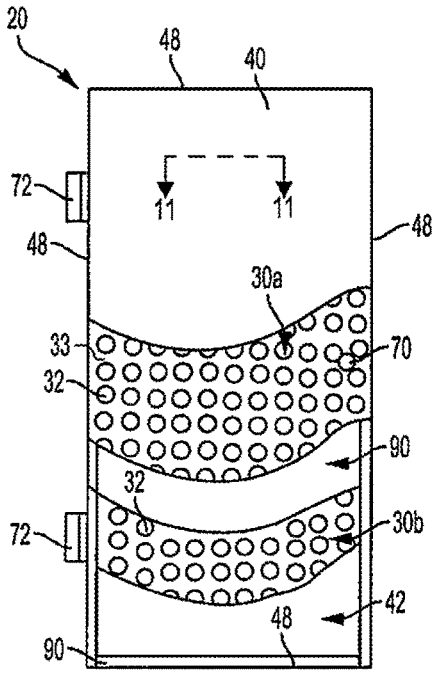
FIG. 8 is a cutaway front elevational view with partial cutaway of an embodiment of the insulated, blast- and/or ballistic-resistant reinforced door panel according to the present invention.

FIGS. 5-7 show another embodiment of the insulated reinforced door panel 20' of the present invention. The door shell again includes inner and outer panels 40 and 42, and side, upper, and lower door edges 48.

In the interior portion between the inner and outer exterior panels a plurality of spaced-apart elongated structural stiffeners 50 extend substantially between the door edges. Although stiffeners 50 are shown extending vertically from the top to the bottom edges of the door, they may extend horizontally from one side to the other, or in any other direction. The stiffeners may be made of a fiber reinforced polymer (FRP), such as glass fiber reinforced polymer (GFRP), aramid fiber reinforced polymer (AFRP), carbon fiber reinforced polymer (CFRP), or the like. FRP stiffeners are described in U.S. application Ser. No. 15/662,936, the disclosure of which is hereby incorporated by reference. The drawings show a FRP rod 50 which has glass fibers spirally wrapped 54 about the exterior (FIG. 5). The FRP may be anisotropic or isotropic in mechanical properties, and generally has significantly higher tensile strength and lower modulus of elasticity than steel. As a result, a stiffener made of FRP may be made of comparable or greater strength than steel, with significantly lower mass. The FRP stiffener may be of any cross-section desired, such as circular or rectangular.

As shown, the FRP stiffener 50 is of a substantially circular configuration. The diameter of the stiffeners may typically be in the range of 0.25 in to 0.75 in., for example 0.375 in. or 0.5 in. The stiffener diameter may typically be in the range of 20% to 50% of the interior door thickness, and may be in the range of 20% to 30% thereof. The stiffeners 50 should be provided in configuration, number, and size to provide sufficient structural integrity to maintain the desired strength of the door. Stiffeners 50 are sized and spaced from inner and outer door panels 40, 42, so a gap exists and there is no direct contact between the mid-portions of the stiffeners between ends 52 and the inner surface of the door panels or skins.

On one or either side of stiffeners 50 are disposed a polymeric sheet 30, between the stiffeners and the interior of the panels or skins 40, 42 (FIG. 6). Each sheet 30 may be of a thickness to fill either less than, or the entire, gap between the stiffeners and the panels or skins, for example, 0.5 in. each. The polymeric sheets 30 may be bonded to the adjacent door panels or skins 40, 42 in the manner described above in connection with the embodiment of FIGS. 1-4. To hold the stiffeners 50 in place within the door interior, the ends 52 are secured to positioning members shown as end caps 80, which are themselves secured to frame members 90 at the top and bottom door edges 48. Stiffeners 50 may be secured to frame members directly. In the embodiment shown, the end caps are formed from sections of the thermoplastic honeycomb sheets, and the stiffeners 50 are bonded into the openings 82 in the thermoplastic honeycomb end cap sections 80. Thermoplastic honeycomb end caps are described in U.S. application Ser. No. 15/679,273, the disclosure of which is hereby incorporated by reference. The longitudinal axes passing through the centers of the end cap openings 82 are oriented 90° (perpendicular) to the longitudinal axes passing through the centers of polymeric sheet openings 82.

The FRP rod ends 52 may be secured into the end cap openings with an adhesive, for example, epoxy. Alternatively, the stiffener ends 52 may be mechanically locked in position by a tight sliding interference fit into the end cap openings 82. Other bonding methods and materials may alternatively or additionally be used to secure the stiffener ends 52, including but not limited to mechanical fasteners, such as a lock washer. Both ends of the stiffeners are secured to the end caps, and similar end caps 80 (not shown) are provided at the top end of door panel 20' secured to top frame 90 at top edge 48 between door panels or skins 40, 42.

Insulation material 60 may be inserted between adjacent stiffeners and to fill the interior cavity formed between polymeric sheets 30, such as the aforedescribed expanded foam. The foam when cured acts to provide thermal insulation through the thickness of the panel. Additionally, the cured foam adheres to and acts to lock the mid-sections of stiffeners 50 in place, between the ends 52, to prevent movement of the stiffeners from side-to-side, in the directions of the panel side frame members 94. The FRP stiffener composition may also be selected so that the insulation material 60 when cured chemically bonds to the FRP stiffener surface, so that the stiffeners and insulation are integral with one another. The use of FRP for the stiffeners also improves the thermal insulation of the door, since the FRP has more thermal insulation value than and is more thermally and electrically non-conductive than stiffeners made of steel or other metals. Additionally, the FRP stiffeners are corrosion resistant and provide dimensional stability to the panel under thermal loading. The cured-in-place structural combination of the foam and stiffeners eliminates the need to have the stiffeners, in the mid-portions between the ends 52, otherwise separately adhered to the adjacent sheets 30 to prevent such side-to-side movement.

In a method for making the reinforced structural or door panel of the first embodiment (FIGS. 1-4), if stiffeners are to be used the ends 52 of a plurality of the stiffeners 50 are slid tightly into openings 82 of positioning members 80 to lock them in place mechanically. The stiffeners may alternatively be interference fitted or otherwise bonded at their ends 52 to end caps 80. Polymeric sheets 30 are positioned on each side of stiffeners 50. The end caps 80 are secured to the upper and lower frame members 90. Optionally, the stiffeners are secured to frame members 90 directly. If stiffeners are not used, one or more of the polymeric sheet(s) 30 are positioned adjacent one of the panels 40, 42. Whether or not stiffeners are used, bonding material is applied between the polymeric sheets 30 and the adjacent door panels or skins. The opposite ends of upper and lower frame members 90 are attached to side frame members 94 formed by folding side edges of outer panel 42, and inner panel 40 is secured over and covering the frame members 90, 94 and internal stiffeners 50. The structural members, sheets and door skins or panels may be assembled in any desired sequence.

Flowable foam is then injected into any cavities between the inner and outer panels, frame members, stiffeners and polymeric sheets. The injection may be made through foam slot(s) 96 in the frame member(s) at ends or edges of the door shell. If stiffeners are used and the polymeric sheets are of a thickness that provides a gap between the sheet and the stiffener, foam may flow between the sheets and stiffeners to fill substantially all of the cavities making up the interior volume. Where the stiffeners contact the inside surfaces of polymeric sheets, a foam inlet will be provided between each pair of stiffeners, or between a stiffener and the door side frame member. The flowable foam may be a foam material that expands upon contact with the atmospheric air or alternately a two-part foam that expands upon mixing the two parts together. The stiffeners may include openings or slots along the stiffener length which allow the expanding foam to flow from one cavity to an adjacent cavity. The flowable foam then hardens and is bonded to the inside surfaces of the polymeric sheets, frame members, and stiffeners. If foam is to be used to bond the polymeric sheets to the inner and outer panels, then it is pumped into the gaps therebetween in a similar manner. The foam acts both as thermal insulation material and bonds to the door skins or panels, polymeric sheets and stiffeners as an adhesive or direct chemical bond.

In a method for making the blast- or ballistic-resistant embodiment of the reinforced door panel (FIGS. 8-11), the polymeric sheets 30*a*, 30*b* are positioned in order with the core blast- or ballistic-resistant material layer(s) 180. One or more of the polymeric sheet(s) 30*a*, 30*b* are positioned adjacent one or more of the panels 40, 42. Bonding material is applied between the polymeric sheets 30*a*, 30*b* and the adjacent door panels or skins, and optionally between the polymeric sheets 30*a*, 30*b* and the core blast- or ballistic-resistant material layer(s) 180. The opposite ends of upper and lower frame members 90 are attached to side frame members 94 formed by folding side edges of outer panel 42, and inner panel 40 is secured over and covering the frame members 90, 94 and internal stiffeners 50. The structural members, sheets and door skins or panels may be assembled in any desired sequence.

Instead of using the bonding adhesive, the honeycomb polycarbonate sheets are spaced from the exterior panels 40, 42, and a flowable foam is then injected into cavities therebetween. The injection may be made through foam slot(s) 96 in the frame member(s) at ends or edges of the door shell. The polymeric sheets may also be spaced from the core blast- or ballistic-resistant material layer, and foam injected between. The flowable foam may be a foam material that expands upon contact with the atmospheric air or alternately a two-part foam that expands upon mixing the two parts together. The flowable foam then hardens and is bonded to the inside surfaces of the polymeric sheets, frame members, and stiffeners. The foam acts both as thermal insulation material and bonds to the door skins or panels, polymeric sheets and stiffeners as an adhesive or direct chemical bond.

Thus, the present invention provides a door panel in which polymeric sheet(s), with or without structural framework of fiber reinforced polymer, improves the structural integrity and thermal efficiency of the door or other wall panels, and, if without an FRP framework but in combination with blast- or ballistic-resistant material, improves the structural integrity, blast- and ballistic-resistance, and thermal efficiency of the door or other wall panels.

In these embodiments, the polycarbonate core can be used in hollow metal, wood, and FRP door designs potentially reducing the number of core types and inventory used in manufacturing. The invention provides major reduction in weight without sacrificing structural strength and blast and ballistic resistance (if employed), is dimensionally stable to reduce thermal bow effect, provides sound transmission class (STC) improvement due to core design and construction, and provides improvement in thermal insulation and air infiltration. The invention provides the option to encapsulate the polycarbonate core with foam in place polyurethane to bond the interior components, polycarbonate core and skins and/or use structural adhesives (epoxy) to bond the polycarbonate core and components to skins.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A structural panel which may be used as a door comprising:

a shell having spaced first and second exterior panels and frame members adjacent edges of the panels;

a plurality of polymeric sheets parallel to and spaced apart from each other between the first and second exterior panels, each of the polymeric sheets being made of a thermoplastic material and having a plurality of openings through a thickness thereof, the openings being spaced apart by wall portions of each of the polymeric sheets, the wall portions being parallel to the first and second exterior panels, the plurality of polymeric sheets being adjacent to the exterior panels and bonded to the adjacent exterior panels; and a plurality of stiffeners disposed between the spaced apart plurality of polymeric sheets.

2. The panel of claim 1 wherein the wall portions of the plurality of polymeric sheets are flat.

3. The panel of claim 1 wherein ends of the stiffeners are secured by a polymeric end cap made of a thermoplastic material having a plurality of openings through a thickness thereof, the ends of the stiffeners being received within the openings of the polymeric end cap, axes of the openings of the polymeric end cap being oriented 90° to axes of the openings of the polymeric sheets.

4. The panel of claim 1 wherein a foam insulation material fills substantially all of the space between the polymeric sheets, stiffeners and frame members in the shell interior portion.

5. The panel of claim 1 including at least one blast- or ballistic-resistant core layer adjacent the plurality of polymeric sheets.

6. The panel of claim 5 wherein the at least one blast- or ballistic-resistant core layer is disposed between the plurality of polymeric sheets.

7. The panel of claim 1 wherein at least one of the plurality of polymeric sheets are spaced from an adjacent exterior panel and a foam insulation material fills substantially all of the space therebetween.

8. A method of making a structural panel which may be used as a door comprising:

providing first and second exterior panels for a door shell;

providing frame members for the door shell;

providing a plurality of polymeric sheets being made of a thermoplastic material and having a plurality of openings through a thickness thereof, the openings being spaced apart by wall portions of each of the polymeric sheets;

providing a plurality of stiffeners comprising a thermally non-conductive fiber reinforced polymer;

assembling the first and second exterior panels, frame members and plurality of polymeric sheets to make a shell having spaced first and second exterior panels and frame members adjacent edges of the panels, the plurality of polymeric sheets being disposed between adjacent exterior panels, the wall portions being parallel to the first and second exterior panels, and the plurality of stiffeners being between the polymeric sheets; and bonding the plurality of polymeric sheets to adjacent exterior panels.

9. The method of claim 8 wherein at least one of the plurality of polymeric sheets are spaced from an adjacent exterior panel and further including injecting a curable and hardenable foam insulation material therebetween, the insulation when cured providing both thermal insulation and a chemical bond with the at least one of the plurality of polymeric sheets and exterior panels.

10. The method of claim 8 wherein the wall portions of the plurality of polymeric sheets are flat.

11. The method of claim 8 further including:

providing at least one blast- or ballistic-resistant core layer; and assembling the at least one blast- or ballistic-resistant core layer adjacent at least one of the plurality of polymeric sheets.

12. The method of claim 11 further including assembling the at least one blast- or ballistic-resistant core layer between the polymeric sheets.

13. The method of claim 11 wherein at least one of the plurality of polymeric sheets is spaced from an adjacent exterior panel and further including injecting a curable and hardenable foam insulation material therebetween, the insulation when cured providing both thermal insulation and a chemical bond with the at least one polymeric sheet and exterior panels.

* * * * *